US008113447B1

(12) United States Patent
Giguere

(10) Patent No.: US 8,113,447 B1
(45) Date of Patent: Feb. 14, 2012

(54) CORN MILLING PROCESS

(75) Inventor: R. James Giguere, Estes Park, CO (US)

(73) Assignee: Cereal Enterprises, Inc., Estes Park, CO (US)

( * ) Notice: Subject to any disclaimer, the term of this patent is extended or adjusted under 35 U.S.C. 154(b) by 159 days.

(21) Appl. No.: 12/613,067

(22) Filed: Nov. 5, 2009

(51) Int. Cl.
*B02C 9/04* (2006.01)

(52) U.S. Cl. ..... 241/11; 241/13; 241/29

(58) Field of Classification Search ..... 241/9, 11, 241/13, 29, 3
See application file for complete search history.

(56) References Cited

U.S. PATENT DOCUMENTS 3,430,869 A * 3/1969 Odden ..... 241/9
4,189,503 A 2/1980 Giguere
4,220,287 A * 9/1980 Boczewski ..... 241/9
4,301,183 A 11/1981 Giguere
4,365,546 A 12/1982 Giguere
4,655,400 A * 4/1987 Erb et al. ..... 241/29
5,250,313 A 10/1993 Giguere
6,098,905 A * 8/2000 Salem et al. ..... 241/3
6,372,281 B1 * 4/2002 Metzger et al. ..... 426/622

OTHER PUBLICATIONS

Theodore E. Stiver, Jr., "American Corn Milling Systems for De-Germed Products," *Bulletin-Association of Operative Millers*, pp. 2168-2179. Jun. 1955.

* cited by examiner

*Primary Examiner* — Bena Miller
(74) *Attorney, Agent, or Firm* — Stinson Morrison Hecker LLP

(57) ABSTRACT

A corn milling process comprising fracturing corn kernels into relatively large particles, and passing the fractured particles between a pair of counter-rotating rollers, each of which presents fine corrugations of the type that normally characterizes the end of a differential corn milling process. The ratio of the roll speeds between the differential rollers is between approximately 1.1-1.4:1. The rollers are spaced apart a distance to grind the endosperm portion of the corn kernel particles while avoiding substantial penetration of the roller corrugations into the germ portion of the particles thereby separating the germ and endosperm portions without reducing the size of the germ.

16 Claims, 6 Drawing Sheets

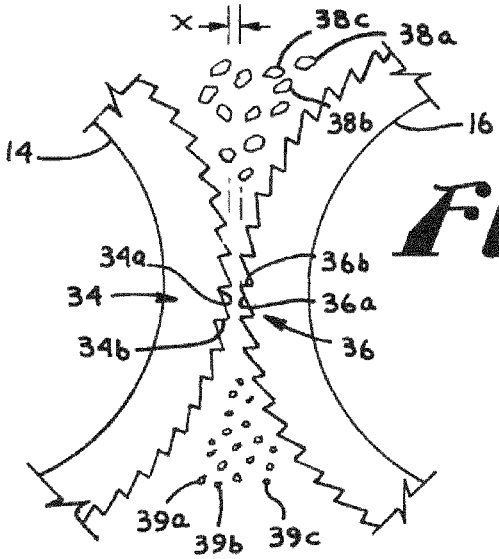
Fig.3.
Fig.4.
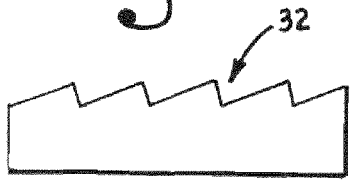
Fig.5.
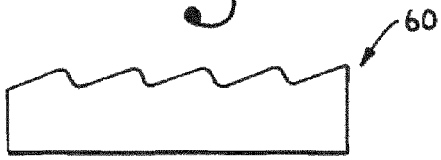
Fig.8.
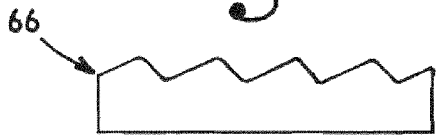
Fig.6.
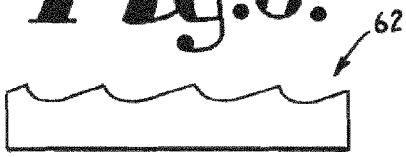
Fig.9.
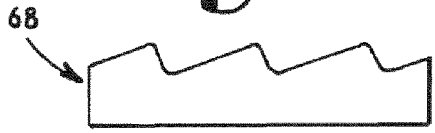
Fig.7.
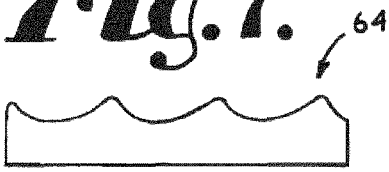

Starch Yield, Oil Yield, & Endosperm Starch Content

CORN MILLING PROCESS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to grain milling generally, and more particularly, to an improved differential corn milling process.

2. Description of Related Art

In a conventional corn milling process, corn kernels are cleaned, tempered, and then sent to a degerminator, which attempts to remove the germ from each kernel without substantially grinding the germ. The corn particles exiting the degerminator are separated into "tail" and "thru" streams, the former being relatively rich in endosperm and the latter being relatively rich in bran and germ. Each stream is then preferably passed through aspirators for bran removal and gravity tables to achieve further sorting of each stream by particle density.

Next, each stream is passed through a series of differential roller mills and sieves to grind and separate the corn particles within each stream to a desired size and purity. Typically, there are two series of differential roller mills, one for the endosperm rich stream (i.e. the break rollers) and one for the germ rich stream (i.e. the germ rollers). Each series consists of successive roller mills designed to gradually reduce endosperm particle size. Each roller mill consists of a pair of counter-rotating rollers which rotate at different speeds and have corrugations designed to grind the endosperm particles. Typically, the germ rollers have a lower roll speed differential than the break rollers in order to reduce grinding and abrasion on the relatively fragile germ.

The first roller mill in each series typically has relatively large corrugations (e.g. approximately 6 corrugations per inch) and the final roller mills in each series typically have relatively small corrugations (e.g. approximately 16-24 corrugations per inch). Relatively large particles from the gravity tables go to the first break or germ rollers, respectively, while smaller particles go to subsequent break or germ rollers. The particles are ground, separated, and re-ground until the desired separation and particle size is achieved. This gradual reduction process subjects corn kernels to multiple grinding and separating steps which can cause undesirable degradation of the germ stream. Further, the process does not separate all of the recoverable germ, and the oil contained therein, from the endosperm stream.

The assignee of the present application owns four patents directed toward a revolutionary corn milling process and degerminator invented by R. James Giguere, which eliminates many of the conventional corn milling steps that are described above: U.S. Pat. No. 4,189,503; U.S. Pat. No. 4,301,183; U.S. Pat. No. 4,365,546; and U.S. Pat. No. 5,250,313, all of which are incorporated by reference herein. According to the process described in these patents, corn kernels preferably are first fractured in a degerminator having opposed corrugated surfaces that crush the kernels from their thin edges to separate the germ and endosperm without damaging the germ. The fractured particles exiting the degerminator are then sent to a break roll having relatively fine corrugations of the type that normally characterizes the end of a differential milling process. The rollers are spaced apart a distance to grind the endosperm portion of the kernels without reducing the size of the germ. The stream exiting the break roll is then passed through sieves and may be ground further until a desired size and purity is achieved.

The assignee of the present application also previously developed the following corn milling process which is similar to the process described in the assignee's above described patents. According to this process corn kernels are first fractured in a pre-break mill or degerminator. The fractured corn particles are then passed through a break roller mill of the type that normally characterizes the end of a differential corn milling process (i.e. the roller corrugations are relatively small). The differential roll speed for the roller mill is no less than 1.6:1 as it was believed that any lower differential would not sufficiently grind the endosperm of the kernels. Sieves are then used to separate the particles into respective germ and endosperm streams. The grinding and separating steps are preferably repeated until the germ and endosperm are sufficiently separated. While the assignee of the present invention's previous processes have proven to be advantageous over the conventional process using two series of successive roller mills, there is room for further improvement in germ and endosperm separation.

BRIEF SUMMARY OF THE INVENTION

The corn milling process according to the present invention starts by fracturing corn kernels into relatively large particles at least some of which comprise both an endosperm and a germ portion of the kernels. Next, the fractured particles are passed between a pair of counter-rotating rollers, each of which presents fine corrugations of the type that normally characterizes the end of a differential corn milling process. The rollers rotate at different speeds thereby allowing the corrugations to grind the endosperm portion of the particles. The ratio of the roll speeds between the differential rollers is preferably between approximately 1.1-1.4:1, more preferably between approximately 1.2-1.35:1, and most preferably approximately 1.3:1. The rollers are spaced apart a distance to grind the endosperm portion of the particles while avoiding substantial penetration of the roller corrugations into the germ portion of the particles to achieve separation of the germ and endosperm without reducing the size of the germ.

The corn milling process of the present invention has achieved significant increases in yield over both of the previously known processes described above. When compared with the assignee's previous process having a roll speed differential of 1.6:1, the process of the present invention has increased oil yield after first break by approximately 6%, while at the same time producing an endosperm stream having a higher concentration of starch. Because the process of the present invention achieves better separation of the germ and endosperm after first break, the process recovers more oil, that oil is of higher quality due to undergoing a reduced number of grinding steps, and the endosperm stream is more pure.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

FIG. 3 is a partial side elevational view of the outer surface of the rollers of FIG. 2;

FIG. 4 is a side elevational view of an outer surface of one of the rollers of FIG. 2 showing Dawson type corrugations on the roller surface;

FIG. 5 is a side elevational view of an alternative embodiment of roller surface showing modified Dawson type corrugations;

FIG. 6 is a side elevational view of an alternative embodiment of roller surface showing Minneapolis type corrugations;

FIG. 7 is a side elevational view of an alternative embodiment of roller surface showing Getchell type corrugations;

FIG. 8 is a side elevational view of an alternative embodiment of roller surface showing Allis dull type corrugations;

FIG. 9 is a side elevational view of an alternative embodiment of roller surface showing Nordyke type corrugations;

DETAILED DESCRIPTION OF PREFERRED EMBODIMENT

Figure 1:
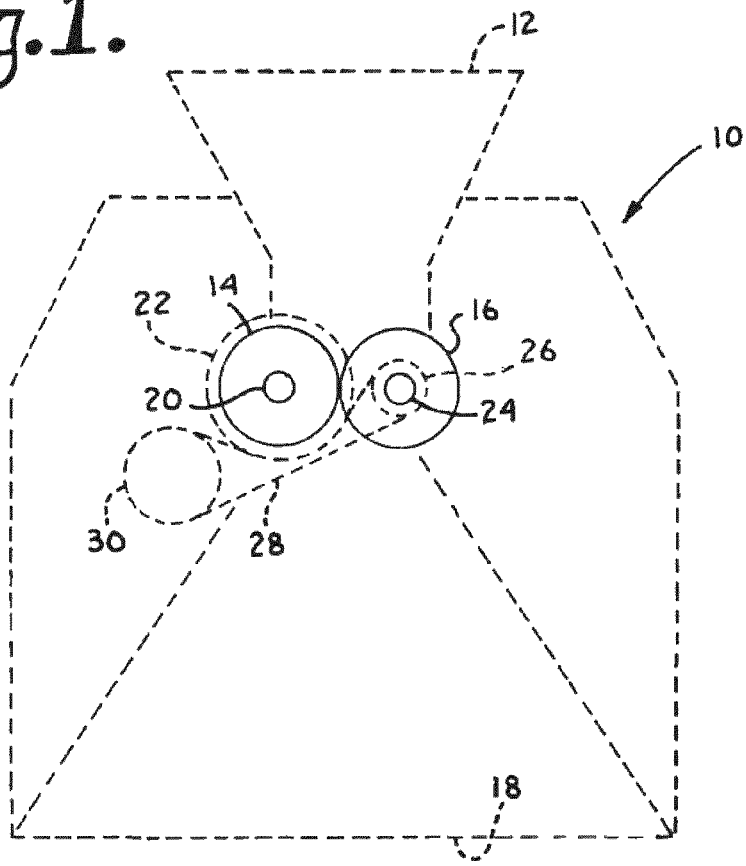
FIG. 1 is a schematic of a differential roller mill for use with the corn milling process of the present invention.

Referring to FIGS. 1-4, a differential roller mill for use with the corn milling process according to the present invention is shown generally as 10. As shown in FIG. 1, the roller mill has an input 12 which receives fractured corn kernels, a pair of counter-rotating rollers 14 and 16 positioned below the input 12 for separating the endosperm, germ, and bran portions of the fractured corn kernels, and an output 18 through which the separated particles pass. Roller 14 is mounted on a shaft 20 along with a pulley 22, and roller 16 is mounted on a shaft 24 along with a pulley 26. A drive belt 28 engages pulleys 22 and 24 and a drive pulley 30 which is coupled with a motor for rotating the pulleys. The belt 28 engages the pulleys 22 and 24 so that the pulleys rotate in opposite directions for effecting counter rotation of rollers 14 and 16. Additionally, pulley 22 is larger than pulley 24 so that roller 14 rotates at a slower rate than roller 16.

Figure 2:
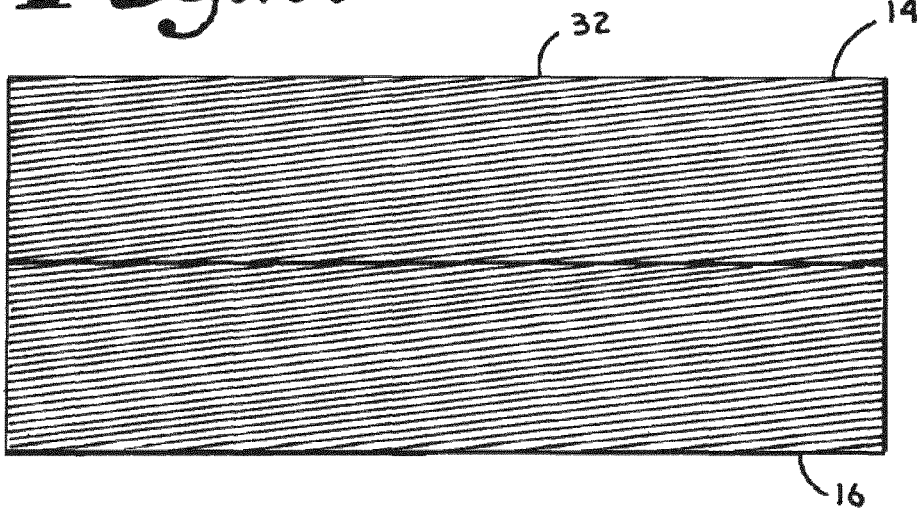
FIG. 2 is a top plan view of a pair of counter-rotating rollers of the mill of FIG. 1.

As shown in FIG. 2, each of the rollers 14 and 16 has rows of corrugations 32 that are positioned at an angle with respect to the axis that the rollers rotate about. In order to show how the rows of corrugations on rollers 14 and 16 separate the endosperm, bran, and germ portions of corn kernels, FIG. 3 shows a corrugation row 34 on roller 14 and a corrugation row 36 on roller 16. As shown in FIG. 3, slower roller 14 rotates in a clockwise direction while faster roller 16 rotates in a counter-clockwise direction. Corrugation row 34 comprises a cutting surface 34*a* and a back surface 34*b*, while corrugation row 36 comprises a cutting surface 36*a* and a back surface 36*b*. This configuration is well known to those skilled in the art of milling as a dull-to-dull configuration. While the present invention preferably utilizes a dull-to-dull configuration, it is within the scope of the invention to utilize a sharp-to-sharp configuration, dull-to-sharp configuration, or sharp-to-dull configuration. Referring again to FIG. 3, there is a gap having a distance x between the apices of corrugations 34 and 36. Preferably, this distance x is adjusted to a distance that produces optimal endosperm and germ separation by moving either of rollers 14 or 16 toward or away from the other roller, as is well known in the art.

As shown in FIG. 3, the corrugations on each of rollers 14 and 16 draw corn kernel particles, such as particles 38*a*, 38*b*, and 38*c*, between the rollers. Those particles having a size that is at least greater than the distance x are crushed and separated into their respective germ, endosperm, and bran portions, such as particles 39*a*, 39*b*, and 39*c*, when the cutting surface 36*a* on faster roller 16 moves past the cutting surface 34*a* on slower roller 14. The speed differential between rollers 14 and 16 causes the corrugation surfaces to crush the endosperm portion of the corn particles thereby separating the endosperm and germ portions.

Figure 10:
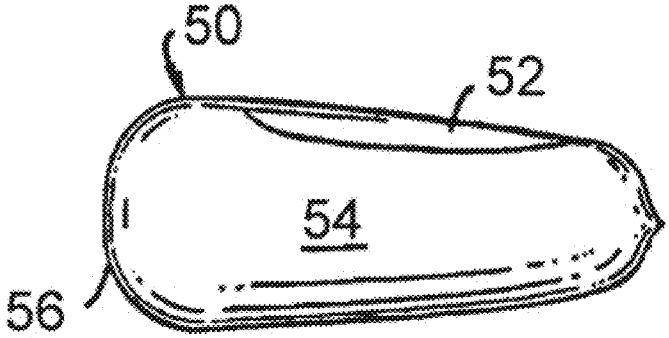
FIG. 10 is a side elevational view of a corn kernel.
Figure 11:
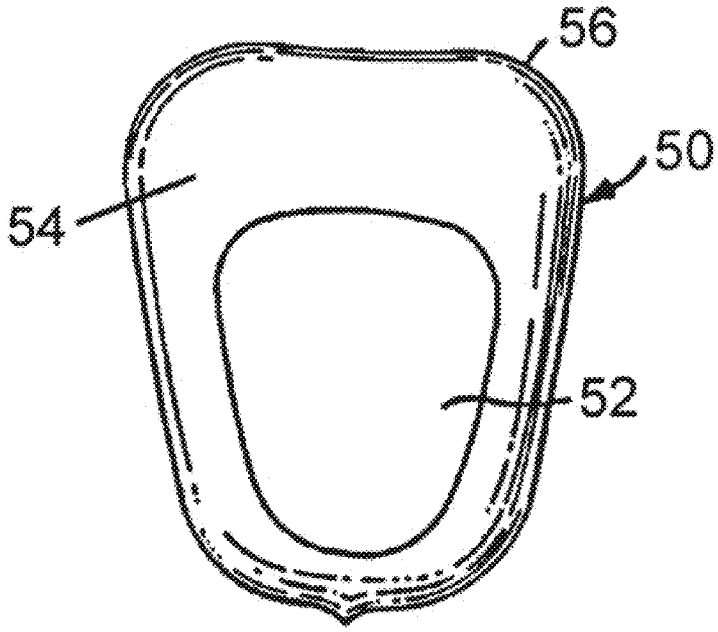
FIG. 11 is a top plan view of the kernel shown in FIG. 10.

To better understand the object of the present invention, FIGS. 10 and 11 show a corn kernel 50, which has a germ portion 52, an endosperm portion 54, and a thin pericarp or bran portion 56 surrounding the germ and endosperm portions. The objective of the corn milling process according to the present invention is to separate these corn kernel portions to achieve a relatively pure stream of each portion. While it is within the scope of the present invention for the separated corn kernel portions to be utilized in any manner, the germ portion 52 may be processed into corn oil and defatted germ meal, the endosperm portion 54 may be processed into grits, corn meal, and corn flour, and the bran portion 56 may be processed into corn bran.

The corrugations 32, 34, and 36 shown in FIGS. 3 and 4 are of the Dawson type; however, any type of corrugations may be used in the process of the present invention. For example, the following types of corrugations may be used in the corn milling process of the present invention: the modified Dawson corrugations 60 shown in FIG. 5, the Minneapolis corrugations 62 shown in FIG. 6, the Getchell corrugations 64 shown in FIG. 7, the Allis dull corrugations 66 shown in FIG. 8, and the Nordyke corrugations 68 shown in FIG. 9.

Figure 12:
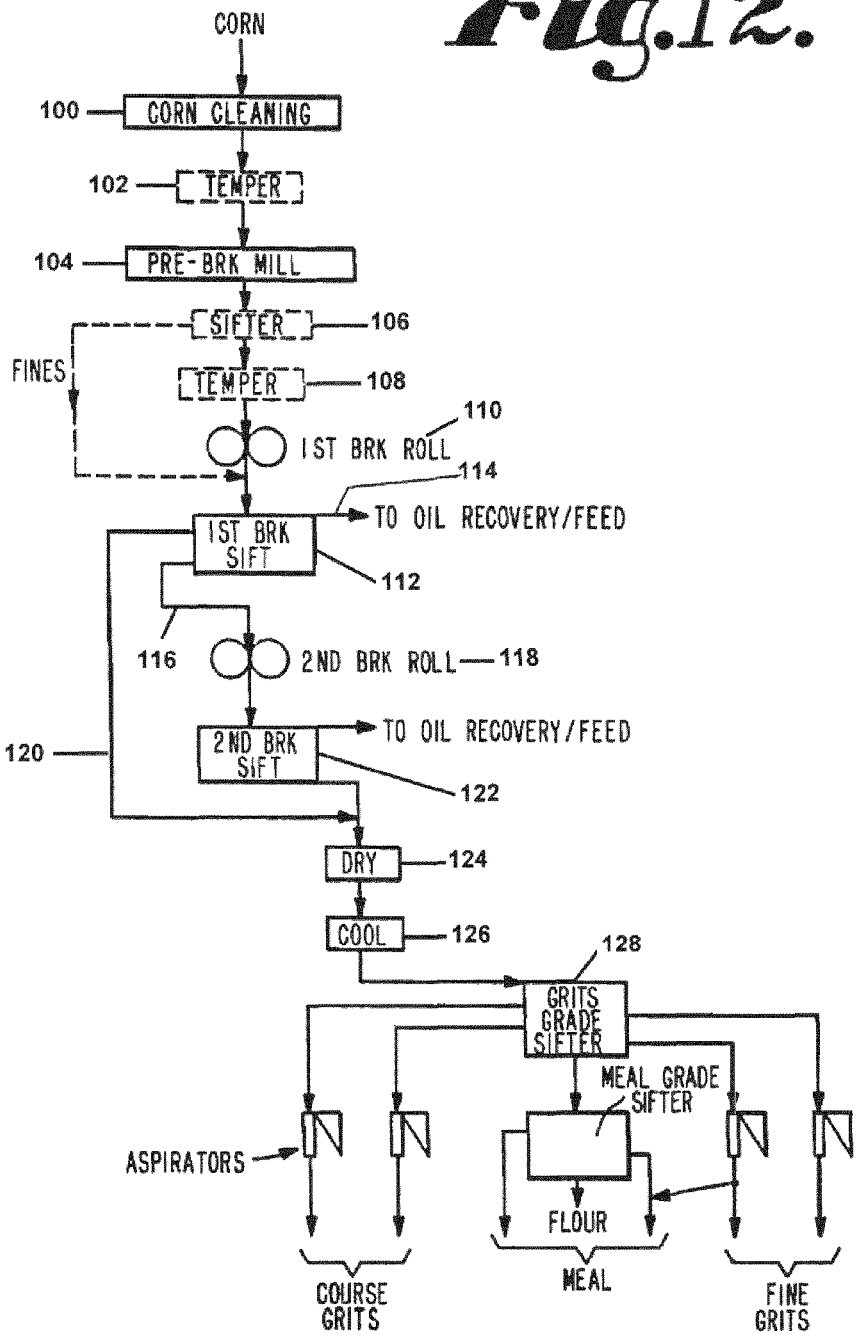
FIG. 12 is a diagrammatic flow sheet of one embodiment of corn milling process according to the present invention.

Referring now to FIG. 12, the preferred process according to the present invention for milling corn to produce food grade corn products is shown. The process begins with the step of cleaning corn kernels 100 to remove contaminants from the corn. Optionally, the corn kernels are then tempered 102 in order to improve subsequent separation of the germ, bran, and endosperm. The kernels may be tempered by any process and for any length of time, as is known in the art. The corn kernels then pass to a pre-break mill 104 which preferably fractures each kernel into relatively large particles for further processing. Preferably, the pre-break mill 104 fractures each kernel into at least four particles some of which comprise both endosperm and germ portions of the kernel and thus require further separation, and more preferably between four to six particles. The pre-break mill 104 preferably breaks the endosperm portion of each kernel to expose the germ portion of each kernel. Preferably, the pre-break mill 104 does not break the germ portion. Any type of pre-break mill may be used in the process of the present invention. For example, any of the pre-break mills or degerminators described in U.S. Pat. No. 5,250,313, which is incorporated by reference herein, may be used in the process of the present invention. Optionally, after pre-breaking, the corn kernel particles pass to a sifter 106 which removes the fines before the particles are tempered 108.

The corn kernel particles then pass to a first break roll 110, which preferably has the same structure as the roller mill 10 shown in FIG. 1. The below description of first break roll 110 refers to the components of roller mill 10 that are shown in FIGS. 1-3. Each roller 14 and 16 of the first break roll 110 has fine corrugations 32 of the type that normally characterizes the end of a differential corn milling process. The difference between fine and coarse corrugations is typically characterized by the number of corrugations per inch on the rollers. Preferably, each roller 14 and 16 in the first break roll 110 of the present invention has between 16 to 20 corrugations per inch. However, it is within the scope of the present invention for the rollers to have more or less corrugations per inch.

As described above, the corrugated rollers 14 and 16 of the first break roll 110 rotate at different speeds in order to separate the germ, endosperm, and bran portions of the corn kernel particles. Preferably, the roll speed ratio of the faster roller 16 to the slower roller 14 is between approximately 1.1-1.4:1, more preferably the ratio is between approximately 1.2-1.35:1, and most preferably the ratio is approximately 1.3:1.

The distance x of the gap between rollers 14 and 16 is set at a distance that allows the corrugations to grind the endosperm portion of each corn kernel particle while avoiding substantial penetration of the corrugations into the germ portion of each particle. Such a distance separates the germ portion and endosperm portion of each corn kernel particle without reducing the size of the germ portion. Preferably, the distance x is such that at least approximately 50% of the ground particles passing from the first break roll 110 will pass through a U.S. #12 sieve. As is know in the art, the distance x may be set at any value to achieve satisfactory separation.

Figure 14:
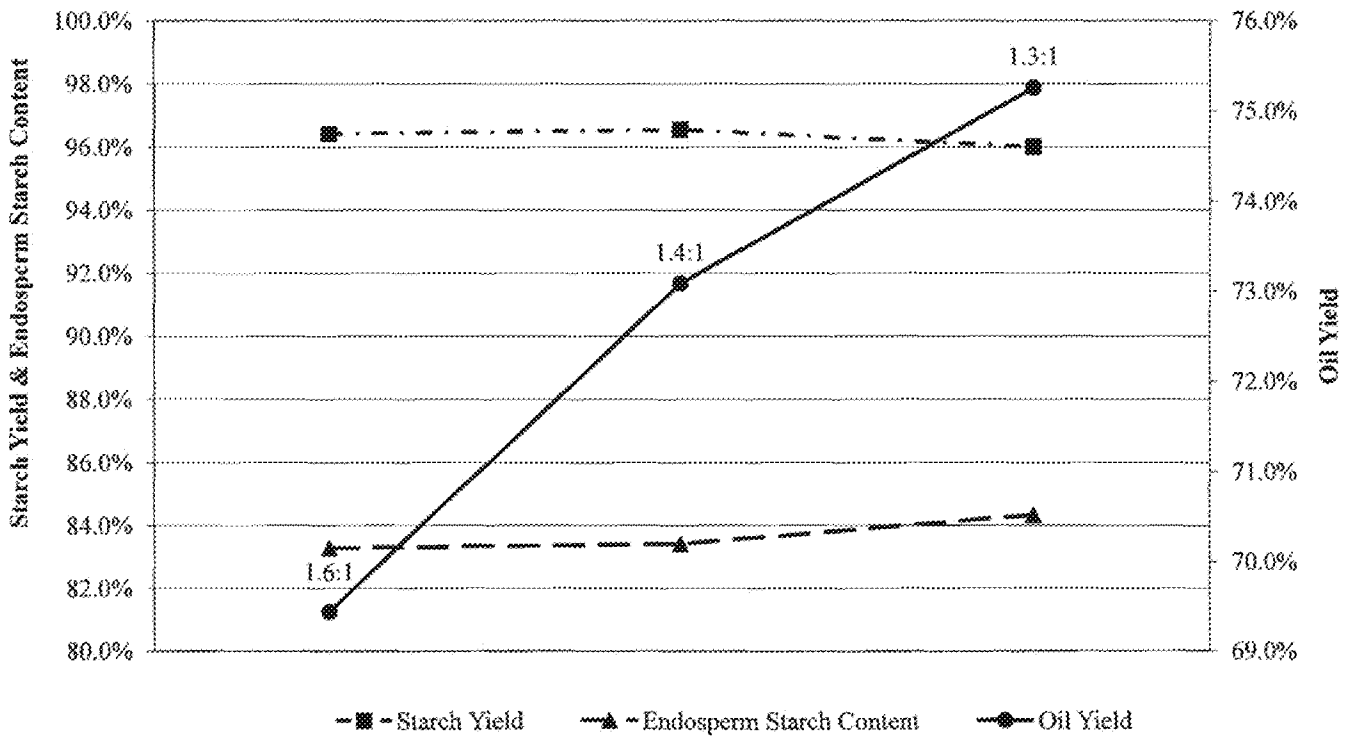
FIG. 14 is a chart comparing the oil yield, the starch yield, and the percent of starch in the endosperm stream between the process of the present invention and a previously known process.

The combination of corrugation size, roller speed ratio, and gap distance for the process according to the present invention achieves better separation of the endosperm and germ portions of a corn kernel than conventional corn milling processes. FIG. 14 is a graph comparing the starch yield, oil yield, and endosperm starch content of ground corn particles after passing through the first break roll 110 of two embodiments of the present invention and the first break roll of the assignee of the present invention's previous process described above in the Background of the Invention section of this application. The test results for the previously known process with a roller speed ratio of 1.6:1 are shown on the left of the graph, while the results for the two embodiments of the present invention with roller speed ratios of 1.4:1 and 1.3:1 are shown in the middle and on the right of the graph, respectively. In addition to changing the roller speed ratio between the three tests, the gap between the rollers that is shown as the distance x in FIG. 3 was gradually reduced from the 1.6:1 test to the 1.3:1 test. It was found that the lower speed differential allowed for a reduction of the gap between the rollers while still maintaining germ quality. The gap was reduced a distance that maximized grinding of the endosperm while still maintaining a desirable germ quality. The roller speed ratio and gap were the only two variables changed between the tests. The oil yield shown in the graph represents the percent of oil in the germ stream divided by the total percent of oil in the corn. The starch yield shown in the graph represents the percent of starch in the endosperm stream divided by the total percent of starch in the corn. The germ stream was defined as the ground particles that passed over a U.S. #6 sieve, while the endosperm stream was defined as the ground particles that passed through a U.S. # 6 sieve. The total percent of oil and starch in the corn was determined by testing a representative sample of the corn. The endosperm starch content shown in the graph represents the percentage of starch in the endosperm stream.

The graph of FIG. 14 shows that the oil yield increased from approximately 69.4% when using the prior art 1.6:1 roller speed ratio to approximately 73.1% with the 1.4:1 roller speed ratio according to the present invention and to approximately 75.3% with the roller speed ratio at 1.3:1. Thus, the 1.3:1 roller speed ratio according to the present invention achieved nearly a 6% increase in oil yield after first break versus the prior art 1.6:1 roller speed ratio. While the graph shows that the starch yield actually decreased from approximately 96.4% with the prior art 1.6:1 roller speed ratio to approximately 96% with the 1.3:1 roller speed ratio according to the present invention, the endosperm starch content increased from approximately 83.3% to approximately 84.3%. It is believed that the decrease in total starch yield for the process according to the present invention is because less germ, which has some starch, was ground to the point that it passed through the sieve into the endosperm stream. This belief is supported by the fact that the concentration of starch in the endosperm stream increased by approximately 1%, which indicates that the process according to the present invention produces a purer endosperm stream than the prior art process.

Because the corn milling process of the present invention recovers more of the total oil present in the corn after first break, there is less oil present in the endosperm stream. It is highly advantageous to recover the germ as soon as possible so that the oil in the germ cannot enter the endosperm stream and increase the fat content of the endosperm stream. Additionally, the earlier that the germ is recovered lessens the likelihood that the oil in the germ will become rancid. Further, the earlier the germ is recovered, the less grinding and abrading that the germ is subjected to, which in turn reduces the release of free fatty acids.

As shown in FIG. 12, after the ground corn kernel particles exit the first break roll 110, they pass to a first break sifter 112, which divides the particles into three streams by sifting them through two sieves of different apertures. The particles that pass over the first, larger aperture sieve make up a first stream 114 that goes to oil recovery/feed. The first stream contains the germ portion of the corn kernels. The particles that pass through the first sieve and over the second, smaller aperture sieve make up a second stream 116 that passes to a second break roll 118 for further separation. The second stream contains both the endosperm and germ portions of the kernels with the majority of which being endosperm. The particles that pass through both the first and second sieves make up a third stream 120 of almost entirely endosperm that is ready for further sifting and packaging. It is within the scope of the invention for the sieves used in the first break sifter 112 to have any size because the preferable sieve size used to separate the germ and endosperm streams can change based on a number of factors including, but not limited to, the type of corn, the moisture content of the corn, the type of pre-break process that the corn undergoes, the gap distance between the rollers, and the corrugation type. For the test the results of which are shown in FIG. 14, the larger sieve was a U.S. #6 sieve. Preferably, the larger sieve used in the first break sifter 112 is sized so that the germ portions of the corn kernels will pass over the sieve. Preferably, the smaller sieve is sized so that ground endosperm particles containing no germ will pass through the sieve.

The endosperm and germ portions of the second stream 116 enter the second break roll 118, which like the first break roll 110, preferably has a structure similar to the differential roller mill 10 shown in FIG. 1. Preferably, the second break roll 118 operates according to the same principles discussed above with respect to the first break roll 110 and within a similar range of operating variables as the first break roll. Like the first break roll 110, the second break roll 118 has two corrugated rollers 14 and 16 which are spaced apart a distance x to grind the endosperm portion of the second stream 116 while avoiding substantial penetration of the roller corrugations into the germ portion. Preferably, there are between approximately 20 to 30 corrugations per inch on each roller in the second break roll 118. Preferably, the roll speed ratio between roller 16 and roller 14 for the second break roll 118 is between approximately 1.1-1.4:1, more preferably is between approximately 1.2-1.35:1, and most preferably is approximately 1.3:1.

After exiting the second break roll 118, the germ and endosperm portions of the second stream are sufficiently separated so that they may be divided from each other at a second break sifter 122. The second break sifter 122 preferably comprises sieves of a single aperture through which the stream exiting the second break roll 118 is passed. The ground particles passing over the sieve comprise primarily germ and are thus directed to oil recovery/feed. The ground particles passing through the sieve comprise primarily endosperm and are thus directed to join the particles from stream 120 to be further sifted and packaged. While the second sieve can be any size for the same reasons discussed above with respect to the first sieve, preferably the second sieve is sized so that germ portions of the kernels pass over the sieve, while ground endosperm passes through the sieve.

FIG. 12 shows that the endosperm particles from stream 120 and the second break sifter 122 are dried at 124, cooled at 126, and then enter a grits grade sifter 128 which separates the particles into different streams of coarse grits, fine grits, and meal. Aspirators are also shown for removing bran from the endosperm. The germ stream also preferably undergoes further processing to extract the oil from the germ.

Figure 13:
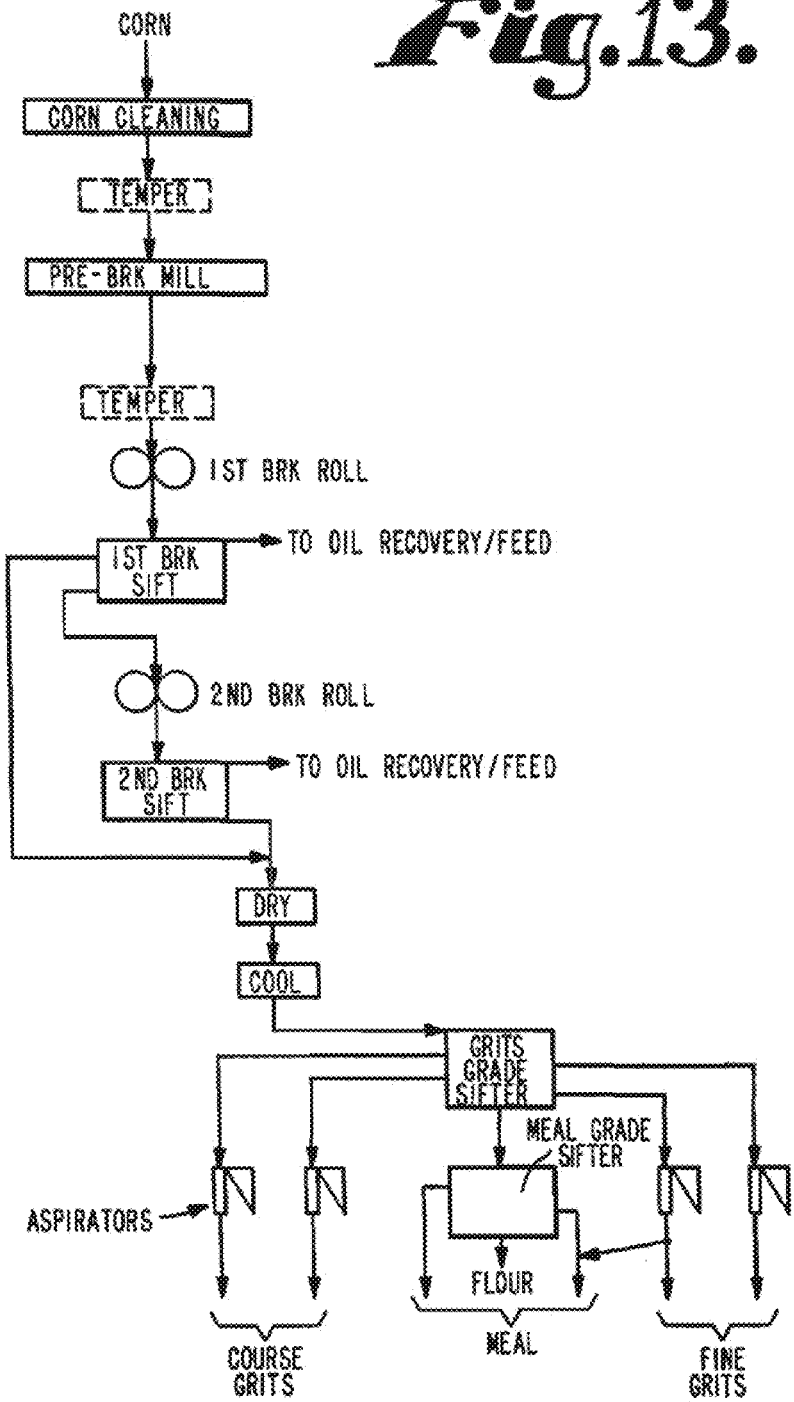
FIG. 13 is a diagrammatic flow sheet of an alternative embodiment of corn milling process according to the present invention.

FIG. 13 shows an alternative embodiment of corn milling process according to the present invention that is preferably used when milling corn for industrial applications. Preferably, this process is identical to the process described above for FIG. 12 except that there is no optional sifting step 106 positioned between the pre-break mill and the first break roll.

Although preferably, the roller mill for use with the processes of the present invention shown in FIGS. 12 & 13 has a structure as described above and shown in FIGS. 1-3, it is within the scope of the present invention for the processes to use any type of differential roller mill. For example, it is within the scope of the present invention to use any type of power transmission system as an alternative to the shafts 20 and 24, pulleys 22, 26, and 30, and belt 28 shown in FIG. 1. Further, it is within the scope of the present invention for the rows of corrugations 32 to be positioned at any angle with respect to the axis that the roller rotates about.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A corn milling process, comprising:

fracturing corn kernels into relatively large particles at least some of which comprise an endosperm portion of the kernels and a germ portion of the kernels; and passing the fractured particles between a pair of counter-rotating rollers, each of which presents fine corrugations of the type that normally characterizes the end of a differential corn milling process, one of said rollers rotating at a first speed and the other of said rollers rotating at a second speed, wherein the ratio of said first speed to said second speed is between 1.1:1 to 1.4:1, said rollers being spaced apart a distance to grind the endosperm portion of the particles while avoiding substantial penetration of said roller corrugations into the germ portion of the particles thereby separating the germ portion and endosperm portion of the particles without reducing the size of the germ portion.

2. The process of claim 1, wherein said rollers are spaced apart a distance so at least fifty percent of the ground particles from said passing step will pass through a U.S. #12 sieve.

3. The process of claim 1, wherein said corrugations on each of said rollers comprise modified Dawson type corrugations.

4. The process of claim 1, wherein there are between approximately 16 to 20 corrugations per inch on each of said rollers.

5. The process of claim 1, wherein said corrugations on each of said rollers are arranged in a dull to dull orientation.

6. The process of claim 1, wherein the ratio of said first speed to said second speed is between approximately 1.2:1 to 1.35:1.

7. The process of claim 6, wherein the ratio of said first speed to said second speed is approximately 1.3:1.

8. The process of claim 1, wherein the step of fracturing the corn kernels comprises fracturing the corn kernels into at least four relatively large particles.

9. The process of claim 1, wherein the step of fracturing the corn kernels comprises fracturing the corn kernels into between four to six relatively large particles.

10. The process of claim 1, further comprising separating the ground particles into a first stream that passes over a first sieve, a second stream that passes through said first sieve and passes over a second sieve, said second stream comprising the endosperm portion and the germ portion of the corn kernels, and a third stream that passes through said second sieve.

11. The process of claim 10, wherein said rollers comprise a first pair of rollers and further comprising passing said second stream through a second pair of counter-rotating rollers, each of which presents fine corrugations of the type that normally characterizes the end of a differential corn milling process, one roller of said second pair of rollers rotating at a third speed and the other roller of said second pair of rollers rotating at a fourth speed, wherein the ratio of said third speed to said fourth speed is between approximately 1.1:1 to 1.4:1, said second pair of rollers being spaced apart a distance to further grind the endosperm portion within said second stream while avoiding substantial penetration of said roller corrugations into the germ portion within said second stream thereby reducing the size of the endosperm portion without reducing the size of the germ portion.

12. The process of claim 11, wherein there are between approximately 20 to 30 corrugations per inch on each roller of said second pair of rollers.

13. The process of claim 11, wherein the ratio of said third speed to said fourth speed is between approximately 1.2:1 to 1.35:1.

14. The process of claim 13, wherein the ratio of said third speed to said fourth speed is approximately 1.3:1.

15. The process of claim 11, further comprising separating said second stream after it passes through said second pair of rollers into a fourth stream that passes over a third sieve and a fifth stream that passes through said third sieve.

16. The process of claim 15, wherein said third sieve comprises a U.S. # 14 sieve.

* * * * *